United States Patent [19]

Grottesi

[11] Patent Number: 5,037,068

[45] Date of Patent: Aug. 6, 1991

[54] HOISTING DEVICE

[75] Inventor: Armando Grottesi, Rome, Italy

[73] Assignee: Meccanica Italiana s.r.l., Rome, Italy

[21] Appl. No.: 329,586

[22] Filed: Mar. 28, 1989

[51] Int. Cl.[5] ..... B66F 3/00

[52] U.S. Cl. ..... 254/8 B; 254/2 R; 254/124; 254/8 R; 182/2

[58] Field of Search ..... 254/2 R, 2 B, 2 C, 4 R, 254/4 B, 4 C, 8 R, 8 B, 8 C, 9 R, 9 B, 9 C, 10 R, 10 B, 10 C, 124; 182/2; 74/52, 99, 103

[56] References Cited

U.S. PATENT DOCUMENTS

| | | | |
|---|---|---|---|
| 2,616,768 | 11/1952 | Stemm | 304/9 |
| 3,103,257 | 9/1963 | Richards | 182/2 |
| 3,168,284 | 2/1965 | Fisher | 254/8 |
| 3,363,474 | 1/1968 | Ritter et al. | 74/52 |
| 3,401,568 | 9/1968 | Blatt | 74/37 |
| 3,415,021 | 12/1968 | Myers | 52/115 |
| 3,743,049 | 7/1973 | Levrini | 182/2 |
| 3,915,429 | 10/1975 | Zelli | 254/8 |
| 4,019,604 | 4/1977 | Benson | 182/2 |
| 4,026,519 | 5/1977 | Piercy | 254/2 |
| 4,056,198 | 11/1977 | Boserup | 214/1 |
| 4,299,533 | 11/1981 | Ohnaka | 414/752 |
| 4,360,187 | 11/1982 | Chapman | 254/8 |

*Primary Examiner*—J. J. Hartman

*Attorney, Agent, or Firm*—Buchanan Ingersoll; George Raynovich, Jr.

[57] ABSTRACT

A camera platform is positioned on the upper end of a lifting mechanism formed by a pair of driving cranks where the outer end of the second crank is connected to the camera platform and the inner end thereof is connected to the inner end of the primary crank. The lower end of the primary crank is pivotally mounted on a mobile chassis which includes a hydraulic system for actuating movement of the primary crank. The inner ends of the primary and secondary cranks are connected by a gear train that provides a two-to-one ratio to multiply the angular movement of the first driving crank to generate movement of the second driving crank in an opposite direction but at twice the angular magnitude of movement. The transmission of angular movement upon actuation of the hydraulic system is accomplished by a double jointed parallelogram system forming the driving cranks and connected to the drive gearing. The angular movement of the first driving crank which is transmitted to the second driving crank raises and lowers the camera platform along a linear path.

9 Claims, 4 Drawing Sheets

HOISTING DEVICE

BACKGROUND OF THE INVENTION

1. Field of the Invention

This invention relates to a device for hoisting a load through a linear path and more particularly to an articulated connection of links drivingly connected to attain a multiplication of angular movement while maintaining a load in a preselected attitude movable through a linear path.

2. Description of the Prior Art

Camera dollies as disclosed in U.S. Pat. Nos. 3,168,284; 3,915,429 and 4,360,187 are well-known in the art and utilize articulated linkages mounted on mobile carriages or frames with power actuating means for initiating upward and downward pivotal movement of the linkage to move a camera platform. A preselected camera attitude is maintained while the camera platform is moved in a substantially linear path. The basic lifting mechanism is based on a conventional scissor type work platform in which one or more load lifting links are connected end-to-end to extend from the base to the camera platform on which the camera is positioned.

The earlier approaches to articulated camera dollies utilized hoisting devices that were substantially complex, requiring a relatively large mobile frame for positioning the camera. Consequently these hoisting devices were difficult to maneuver which limited their versatility in supporting cinematicographic and television cameras.

Articulated linkages for raising and lowering a platform in a substantially linear path for industrial uses are disclosed in U.S. Pat. Nos. 2,616,768; 3,363,474; 3,401,568; 3,415,021; 3,743,049; 4,019,604; 4,026,519; 4,056,198; and 4,299,533. These devices were not readily adaptable to camera hoists which were required to be smaller in scale with a shorter wheel base to provide greater flexibility in maneuvering the camera.

U.S. Pat. No. 4,360,187 discloses a hoisting device having a compact design that includes a dolly-like base on which is pivotally supported a primary hoist link rotatable about a fixed shaft upon actuation of a piston cylinder assembly. A final hoist link is pivotally connected and spaced in lateral relation to the distal end of the lower or primary link by the provision of an intermediate connection designed to transmit angular movement of the primary link into angular movement of the final or upper link having a magnitude equal to the magnitude of angular movement of the primary link. In the fully retracted position the primary and final links are positioned in adjacent parallel relation on the dolly.

SUMMARY OF THE INVENTION

In accordance with the present invention there is provided apparatus for hoisting a load along a linear path that includes a chassis and a hub mounted on the the chassis. A primary driving crank is pivotally connected at one end to the hub. A gear segment is connected to the opposite end of the primary driving crank. A secondary driving crank has a first end portion and a second end portion. Means are provided for supporting a load on the secondary driving crank first end portion. A transverse shaft carries the gear segment and the secondary driving crank second end portion in spaced lateral relation. Gear means rotatably mounted on the primary driving crank and drivingly connected to the gear segment and to the secondary driving crank second end portion transmit rotation from the primary driving crank to the secondary driving crank. Actuation means mounted on the chassis and connected to the primary driving crank rotate the primary driving crank through an angle about the hub. The gear means upon movement of the primary driving crank transmits rotation to the secondary driving crank to rotate the secondary driving crank through an angle greater than the angle of rotation of the primary driving crank and moves the means for supporting the load through a linear path.

Further in accordance with the present invention there is provided a hoisting device for extending and retracting a load support along a linear path that includes a support frame and a first parallelogram link mounted at one end for pivotal movement on the support frame. A second parallelogram link is positioned laterally of the first parallelogram link. Means is mounted on one end of the second parallelogram link for maintaining the load support in a preselected position. A first gear is mounted at the opposite end of the first parallelogram link. A second gear is coaxially mounted with respect to the first gear on the opposite end of the second parallelogram link. Multiplication gear means is carried by the first parallelogram link in meshing relation with the first and second gears for multiplying rotation of the first parallelogram link to generate displacement of the second parallelogram link through a multiple of the angle of the first parallelogram link to linearly move the load between extended and retracted positions with respect to the support frame.

Additionally in accordance with the present invention there is provided a method for hoisting a load along a linear path that includes the steps of pivotally mounting a driving crank for angular movement on a support frame. A load is supported on the ruter end of a driven crank. Adjacent ends of the driving and driven cranks are coaxially mounted in spaced lateral relation for relative angular movement. Rotational movement at the end of the driving crank is generated upon angular movement of the driving crank on a support frame. Rotation from the driving crank is transmitted to the driven crank by a meshing gear train to angularly displace the driven crank through a multiple of the angular movement of the driving crank. The load is maintained in a preselected attitude through a linear path as both the driving and driven cranks move angularly relative to one another.

Accordingly the principal object of the present invention is to provide a compact camera hoist having angular movement of a final link greater than the angular movement of the primary link in the displacement of the camera platform.

Another object of the present invention is to provide an easily maneuverable camera hoist that is compactly stored and when in use provides a wide range of displacement movement for the camera platform.

An additional object of the present invention is to provide a camera hoist that includes a pair of articulated links that provide a multiplication of the angular movement of the final link with respect to the angular movement of the primary link.

These and other objects of the present invention will be more completely disclosed and described in the following specification, accompanying drawings, and appended claims.

DESCRIPTION OF THE PREFERRED EMBODIMENTS

Figure 1:
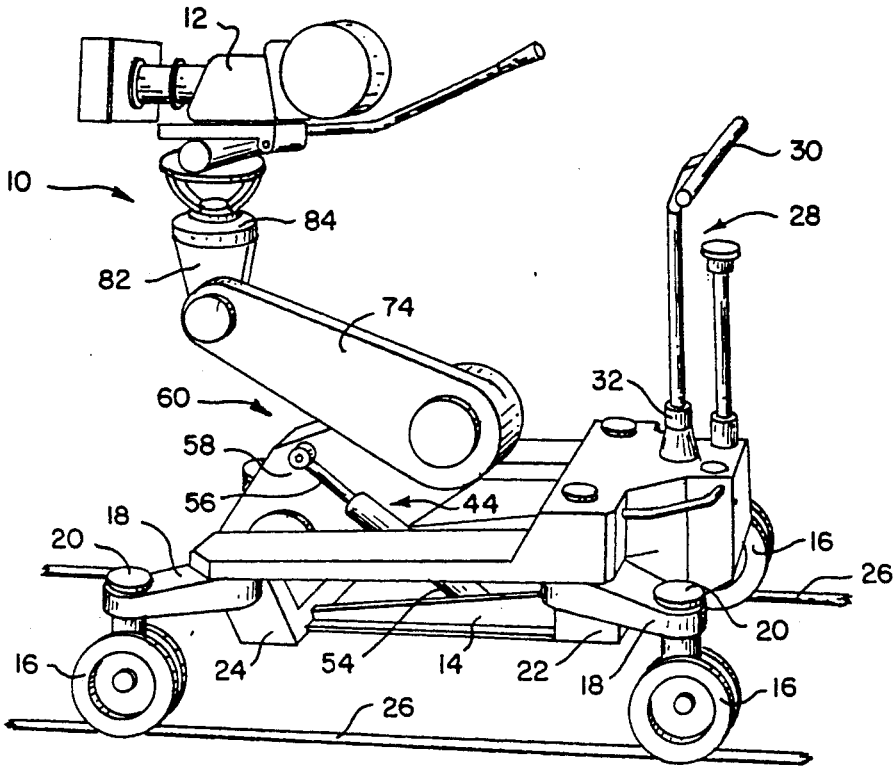
FIG. 1 is a isometric illustration of the hoisting device of the present invention.

Referring to the drawings, and particularly to FIGS. 1-5, there is illustrated a hoisting device generally designated by the numeral 10 for raising and lowering a workpiece, such as a television or movie camera 12, substantially along a vertical path. The hoisting device 10 includes a chassis or frame 14 mounted on wheels 16 connected to the chassis 14 by wheel arms 18. The wheel arms 18 are connected in a manner, not shown, to the chassis 14 to facilitate movement of the wheels through a full 180° angle and to be set in a plurality of selected positions by a lock 20 associated with each wheel. The wheels can thus be independently controlled to rotate freely or to be locked in any position. The chassis 14 includes a front end portion 22 and a rear end portion 24. Most preferably the wheels 16 positioned adjacent the rear end portion 24 are equipped with manually-operated brakes to lock the dolly or chassis 14 in place.

In application the dolly or chassis 14 can be used on a floor or on any standard track 26, as illustrated in FIG. 1. The conversion from floor to rail mount of the chassis 14 can be made without changing the wheels. Preferably the wheels 16 have tires which are flexible.

The hoisting device 10 is steered from the front end portion 22 and is controlled by steering mechanism generally designated by the numeral 28. The steering mechanism includes provision for changing the drive of the chassis 14 from four-wheel operation to two-wheel operation by twisting steering handlebar 30. Steering preferably includes a geared transmission located between the wheels 16 at the rear end portion 24 of the chassis 14 to facilitate steering. In addition the steering handlebar 30 can be removed from the chassis 14 at threaded base 32.

Figure 6:
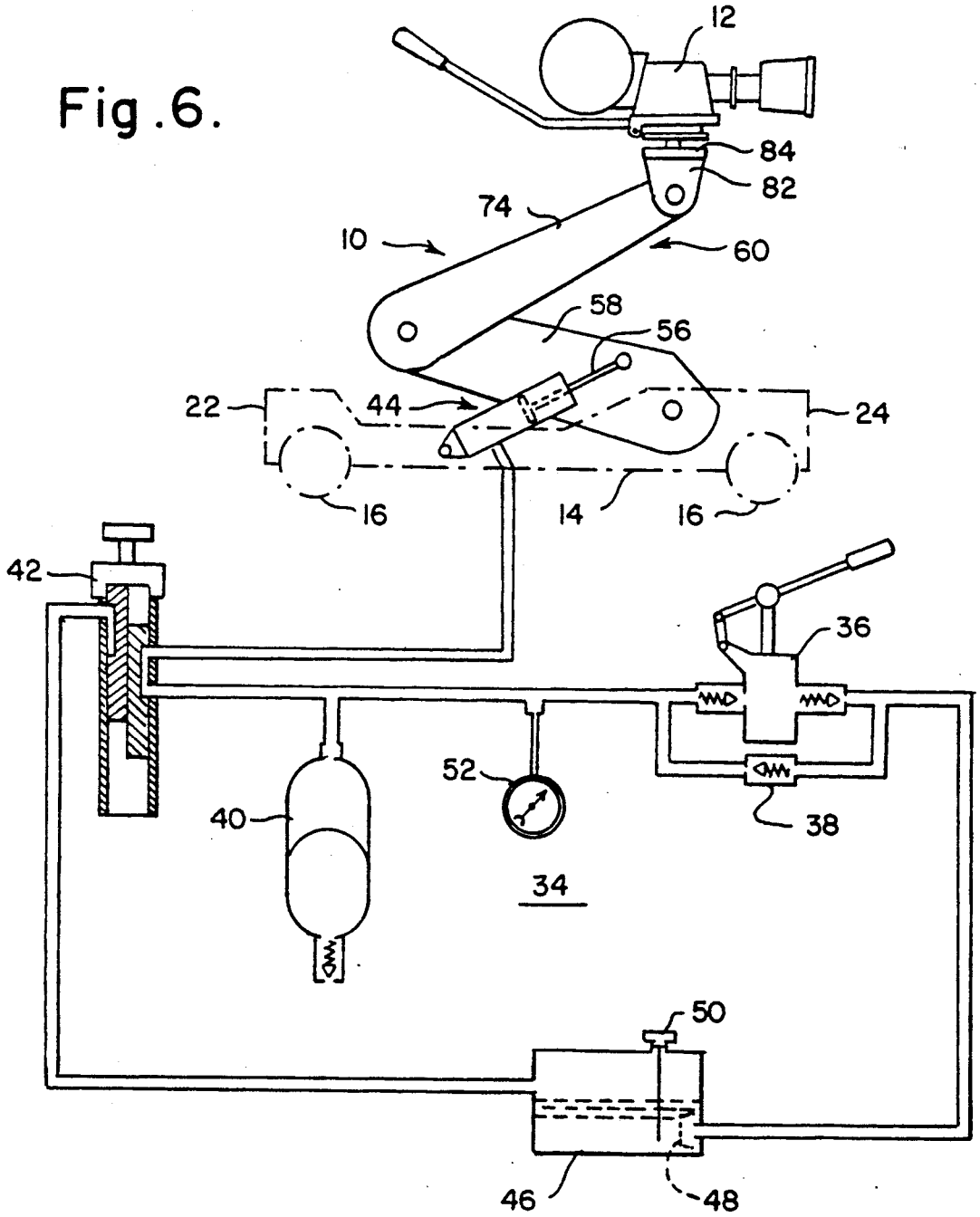
FIG. 6 is a diagrammatic representation of the hydraulic circuitry for actuating movement of the hoisting device.

As schematically illustrated in FIG. 6, the hoisting device 10 includes a hydraulic circuit 34 equipped with a hand pump 36 and associated by-pass valve 38 connected in the fluid circuit to a pressure accumulator 40. The accumulator 40 can be charged by either using the hand pump or by an electrical pump. The pressure accumulator 40 is connected through a control valve 42 to a single acting piston cylinder assembly 44 mounted on the chassis 14 and fluid reservoir 46. The fluid reservoir 46 includes a filter 48 and a stopper and lever control rod 50. In addition a manometer 52 is positioned in the circuit between the hand pump 36 and pressure accumulator 40. With this arrangement circuit 34 can be operated in either a manual or electric mode.

Figure 2:
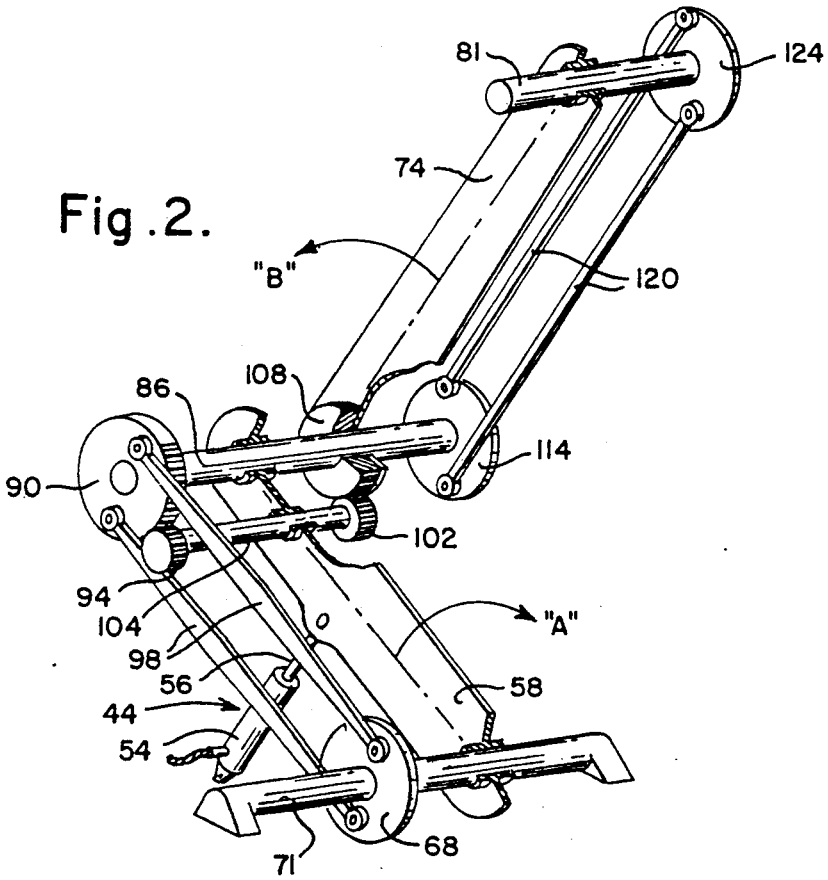
FIG. 2 is a fragmentary isometric schematic of the connection between the primary and secondary driving cranks of the hoisting device shown in FIG. 1.
Figure 5:
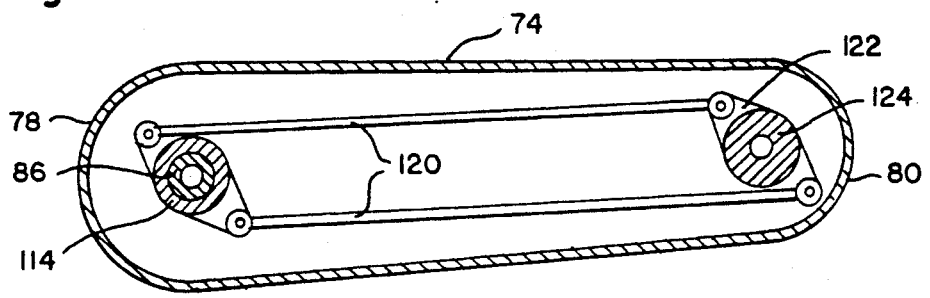
FIG. 5 is a sectional view in side elevation of the secondary driving crank taken along line V—V of FIG. 3.

The piston cylinder assembly 44 shown in FIGS. 1, 2 and 6 includes a base 54 pivotally connected to the chassis 14 and an extensible/retractable piston rod 56 connected at its upper end portion to a primary driving crank 58 of lifting mechanism generally designated by the numeral 60.

Figure 3:
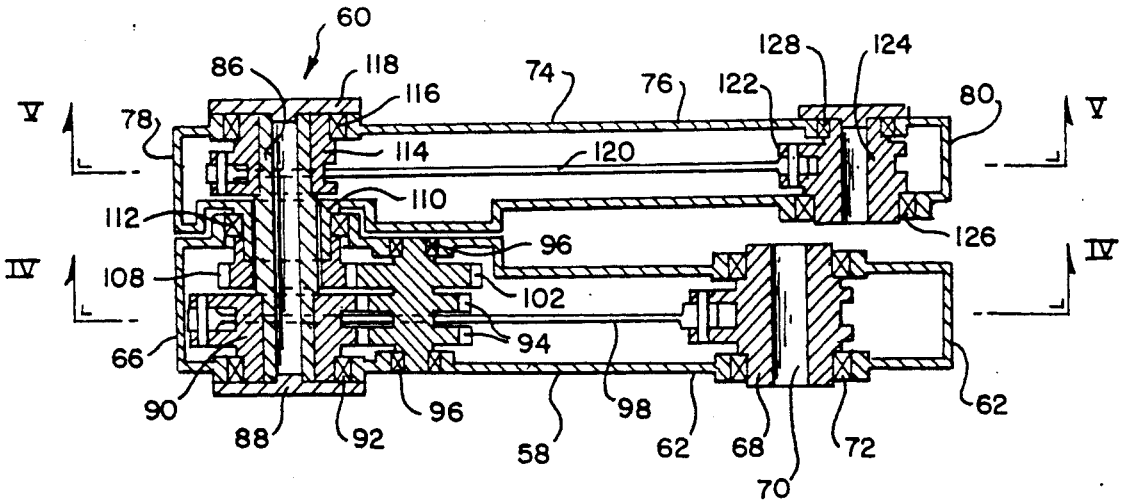
FIG. 3 is a plan sectional view of the connection for the primary and secondary driving cranks.

The details of the lifting mechanism are illustrated in detail in FIGS. 2-5. In FIG. 3 the lifting mechanism 60 is shown to include a housing 62 that forms the primary driving crank 58. The housing 62 includes a first end portion 64 and a second end portion 66. The first end portion 64 is pivotally connected to the chassis 14 by a hub 68 having a through bore 70 for receiving a shaft 71, for example as shown in FIG. 2, connected to the chassis 14. The housing 62 at front end portion 64 is rotatably mounted on the hub 68 by provision of bearings 72.

The primary driving crank 58 is connected to a secondary driving crank 74 at the second end portion 66 of the housing 62. The secondary driving crank 74, in turn, includes a housing 76 having a first end portion 78 connected to the adjacent housing second end portion 66 and a second end portion 80 that is connected by shaft 81, shown in FIG. 2, to vertical arm 82 which supports a camera platform 84 as shown in FIG. 1.

As shown in FIG. 3 the primary driving link 58 and secondary driving link 74 are positioned in spaced lateral relationship and are approximately equal in length. It should be understood that the secondary driving crank 74, for example, may be greater in length than the primary driving crank 58. The respective crank housings 62 and 76 are connected at their adjacent end portions 66 and 78 by a shaft 86 shown in FIGS. 2, 4 and 5, which is covered by end plate 88 shown in FIG. 3.

Figure 4:
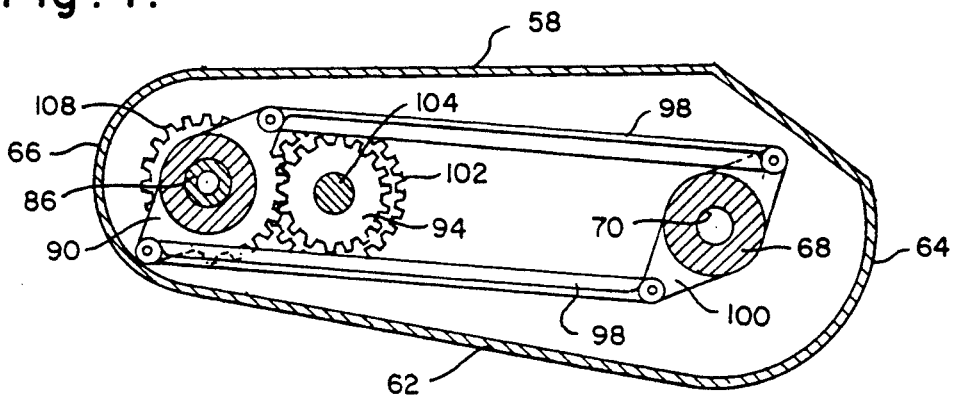
FIG. 4 is a sectional view in side elevation of the primary driving crank taken along line IV—IV of FIG. 3.

A straight tooth gear 90 or a wheel having a gear segment as shown in FIG. 4 is positioned on the shaft 86 and supported within the housing second end portion 66 by bearings 92. The gear 90 meshes with a smaller straight tooth gear 94 that is also rotatably supported within housing end portion 66 by bearings 96. The gear 90 or wheel having a gear segment is connected by a pair of rods 98, as seen in FIG. 4, to a peripheral element 100 of the hub 68. This arrangement of connecting the hut 68 to the gear 90 by the pair of parallel spaced rods 98 forms a first parallelogram. Upon actuation of the piston cylinder assembly 44 to extend the piston rod 56 the first parallelogram as shown schematically in FIG. 2 rotates in a clockwise direction as indicated by the arrow A about the hub 68 mounted on the chassis 14.

Within the housing 62 of the primary driving crank 58 a second straight tooth gear 102 is formed integral with the gear 94 and is positioned laterally thereto. In an alternate embodiment, as shown in FIG. 2, the gear 94 is connected to the gear 102 by a shaft portion 104 such that the clockwise rotation of the primary driving crank 58 is transmitted from the gear 90 to the gear 94 and therefrom to the gear 102. With this arrangement the gears 94 and 102 are rotatably supported within the housing 62 forming the primary driving crank 58.

The articulated connection of the primary driving crank 58 to the secondary driving crank 74 is accomplished by the meshing relation of gear 102 with a gear 108 that is splined to a hub portion 110 of housing end portion 78 of the secondary driving crank 74. As seen in FIG. 3, the housing hub portion 110 extends into the housing end portion 66 of the primary driving clank 58 and is supported therein for relative rotational movement by bearings 112. With this arrangement rotation from gear 102 is transmitted to the gear 108 which in turn transmits rotational movement in a counterclockwise direction to the secondary driving crank 74.

Within the housing first end portion 78 of the secondary driving crank 74, a hub or wheel 114 is non-rotatably mounted on the shaft 86 and is supported for rotation within the housing first end portion 78 by bearings 116. The bearings 116 are sealed within the housing first end portion 78 by end plate 118. The hub 114 is in turn connected by a pair of rods 120 to a peripheral portion 122 of an output hub 124. The output hub 124 is rotationally supported within the housing second end portion 80 by pairs of bearings 126 and 128. With this arrangement the connection of the hub 114 to the output hub 124 by the pair of parallel positioned rods 120 forms a second parallelogram. As discussed above, the arm 82 that supports the camera platform 84 is connected to the secondary driving crank 74 at the housing second end portion 80.

Figure 7:
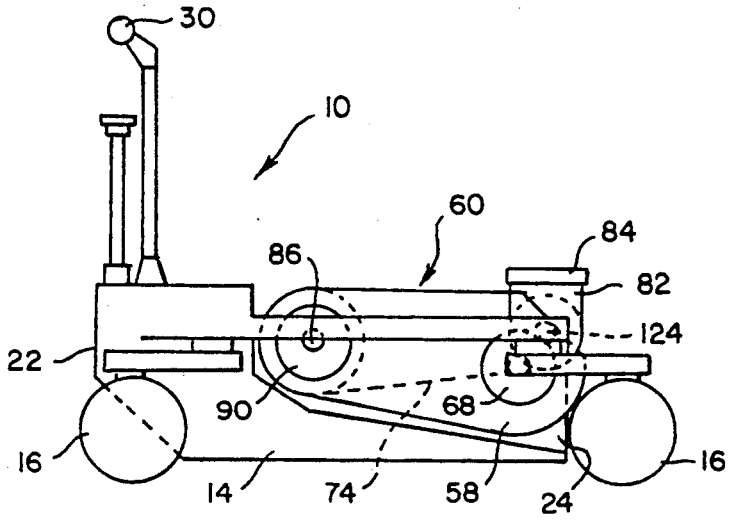
FIG. 7 is a schematic illustration of the hoisting device in an initial position.
Figure 8:
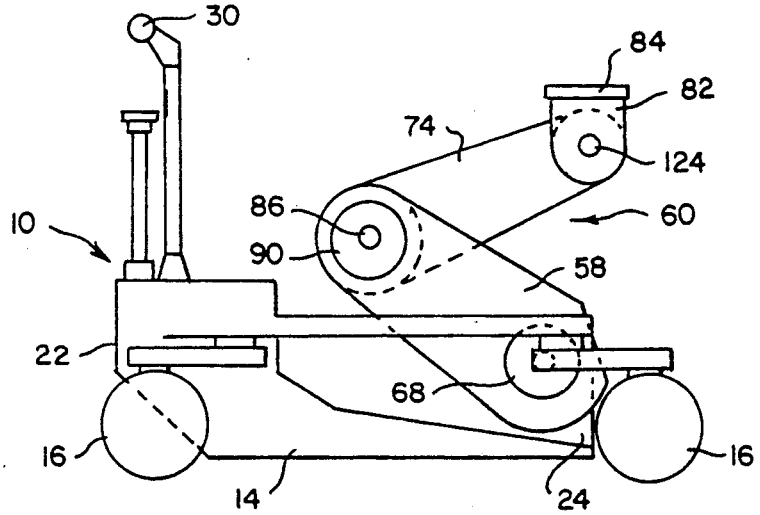
FIG. 8 is a schematic illustration of the hoisting device in an intermediate position.
Figure 9:
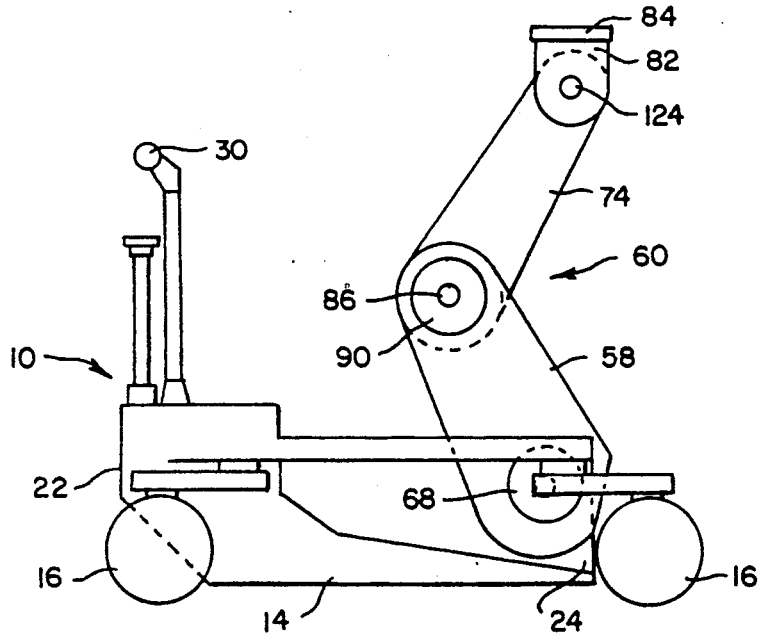
FIG. 9 is a schematic illustration of the hoisting device in a fully extended position.

By operation of the hydraulic circuitry 34 shown in FIG. 6 the camera platform 84 is raised and lowered along a linear vertical path. As shown in FIG. 7, initially the primary and secondary cranks 58 and 74 are positioned in side-by-side parallel relationship on the chassis 14. Actuation of the hydraulic circuitry 34 operates the piston cylinder assembly 44 to extend the piston rod 56 to exert an upward force on the primary driving crank 58 to rotate the crank 58 in a clockwise direction about the hub 68 on the chassis 14. For purposes of illustration the lifting mechanism 60 is schematically illustrated in FIG. 2. The elements shown therein correspond to the structure described above and disclosed in FIGS. 3–5.

To raise the camera platform 84 along a substantially vertical linear path, the piston rod 56 is extended to pivot the primary driving crank 58 through a selected angle "A" as shown in FIG. 2. To raise the camera platform 84 the primary driving crank 58 is rotated in a clockwise direction. The pivotal movement of the housing 62 on the hub 68 is transmitted by the parallelogram arrangement of rods 98 to the gear segment 90 on the shaft 86. As the housing 52 rotates the rods 98 pivot about their connection to the hub 68 to transmit rotation to the gear 90.

Rotation of the gear 90 is, in turn, transmitted to the gear pair 94 and 102 shown in FIGS. 3 and 4. Thus the gears 94 and 102 not only rotate on the periphery of the gear 90 by also rotate about the axes within the housing 62. Rotation is thus transmitted from the gear 90 through the gear 94 to the gear 102. Rotation of the gear 102 is, in turn, transmitted to the gear 108 connected through hub 110 to the housing 76 of the secondary driving crank 74. The gears in the gear train formed by the meshing combination of gears 90, 94, 102, and 108 are selected to provide a two-to-one ratio between gear 90 and gear 108. This arrangement is known as an epicycloidal drive where again the gears 94 and 102 rotate about their axes and around the gears 90 and 108. This gear arrangement is also known as a double epicycloidal system.

Rotation of the gear 108 is then transmitted to the housing 76 of the secondary driving crank 74 and also angular movement to the pair of rods 120 forming the second parallelogram. Through the epicycloidal drive above described the angular movement of the second parallelogram and corresponding secondary driving crank 74 is in a counterclockwise direction as indicated by the arrow in FIG. 2 through an angle "B" which is twice the magnitude of the angle "A" for the movement of the primary driving crank 58. Thus the movement of the secondary driving crank 74 is multiplied by the epicycloidal system.

The angular movement of the secondary driving crank 74 is generated by rotation of the gear 108 through the housing second end portion 78 to the hub 114. The ends of the pair of rods 120 are pivotally connected to the hub 114 and the output hub 124. As the hub 114 rotates the angular movement thereof is transmitted by the pair of rods 120 to the output hub 124 to thus raise the secondary driving crank 74 to an angle greater than the angular movement of the primary driving crank 58.

According to the provisions of the patent statutes I have explained the principle, preferred construction and mode of operation of my invention and have illustrated and described what I consider to represent its best embodiment. However, it should be understood that, within the scope of the appended claims the invention may be practiced otherwise than as specifically illustrated and described.

I claim:

1. Apparatus for hoisting a load at a fixed attitude along a linear path comprising, a chassis, a chassis hub mounted on said chassis, a primary driving crank pivotally connected at one end to rotate about said chassis hub for angular movement relative to said chassis, a gear segment rotatably mounted on the opposite end of said primary driving crank and maintained in a fixed attitude relative to said chassis hub by a first pair of parallel rods pivotally secured to said gear segment and said chassis hub, a secondary driving crank having a first end portion and a second end portion, means including an output hub rotatably mounted on said secondary driving crank for supporting a load on said secondary driving crank second end portion, said gear segment being fixed to one end of a transverse shaft and an intermediate hub being fixed to the other end of said transverse shaft, said secondary driving crank first end portion being rotatably received on said transverse shaft and having an actuating gear non-rotatably fixed to said secondary driving crank first end portion, a second pair of parallel rods pivotally secured to said intermediate hub and to said output hub to maintain said output hub in a fixed attitude to said intermediate hub and, through said transverse shaft and said gear segment, in a fixed attitude relative to said chassis hub, gear means including a gear engaged with said gear segment and a gear engaged with said actuating gear fixed to a common shaft that is rotatably mounted on said primary driving crank for transmitting angular movement of said primary driving crank to said secondary driving crank, actuation means mounted on said chassis and connected to said primary driving crank for rotating said primary driving crank for angular movement relative to said chassis about said chassis hub, and said gear means upon angular movement of said primary driving crank transmitting angular movement to said secondary driving crank to rotate said secondary driving crank relative to said primary driving crank through an angle that is twice the angle of rotation of said primary driving crank relative to said chassis and thereby move said means for supporting a load through a linear path.

2. Apparatus as set forth in claim 1 which includes, a first housing forming and enclosing said primary driving crank, a second housing forming and enclosing said secondary driving crank, said first and second housings being positioned in spaced parallel relation.

3. Apparatus as set forth in claim 2 which includes, means for connecting said actuating gear to said second housing such that upon rotation of said primary driving crank movement of said first housing is transmitted to said second housing for movement of said first and second housings in parallel relation.

4. Apparatus as set forth in claim 1 in which, said gear means includes a pair of gears coaxially mounted and integrally connected for transmitting rotation from said gear segment on said primary driving crank to said actuating gear fixed to said secondary driving crank.

5. Apparatus as set forth in claim 1 wherein said actuation means is a hydraulically actuated piston and cylinder.

6. Apparatus as set forth in claim 1 wherein said output hub is rigidly fixed to the platform supporting said load.

7. Apparatus as set forth in claim 3 wherein said means for connecting said actuating gear to said second housing is a splined connection.

8. Apparatus as set forth in claim 1 wherein said chassis is supported on wheels.

9. Apparatus for hoisting a load at a fixed attitude along a linear path comprising:

a chassis;

a chassis hub mounted on said chassis;

a primary driving crank pivotally connected at one end to rotate about said chassis hub for angular movement relative to said chassis;

a gear segment rotatably mounted on the opposite end of said primary driving crank;

means to maintain said gear segment in a fixed attitude relative to said chassis hub;

a secondary driving crank having a first end portion and a second end portion;

means including an output hub rotatably mounted on said secondary driving crank for supporting a load on said secondary driving crank second end portion;

said gear segment being fixed to one end of a transverse shaft and an intermediated hub being fixed to the other end of said transverse shaft;

said secondary driving crank first end portion being rotatably received on said transverse shaft and having an actuating gear non-rotatably fixed to said secondary driving crank first end portion;

means to maintain said output hub in a fixed attitude relative to said intermediate hub;

gear means including a gear engaged with said gear segment and a gear engaged with said actuating gear fixed to a common shaft that is rotatably mounted on said primary driving crank for transmitting angular movement of said primary driving crank to said secondary driving crank, actuation means mounted on said chassis and connected to said primary driving crank for rotating said primary driving crank for angular movement relative to said chassis about said chassis hub, and said gear means upon angular movement of said primary driving crank transmitting angular movement to said secondary driving crank to rotate said secondary driving crank relative to said primary driving crank through an angle that is twice the angle of rotation of said primary driving crank relative to said chassis and thereby move said means for supporting a load through a linear path.

* * * * *